US008604424B2

(12) United States Patent
Amirav

(10) Patent No.: US 8,604,424 B2
(45) Date of Patent: Dec. 10, 2013

(54) CAPILLARY SEPARATED VAPORIZATION CHAMBER AND NOZZLE DEVICE AND METHOD

(76) Inventor: Aviv Amirav, Hod Hasharon (IL)

( * ) Notice: Subject to any disclaimer, the term of this patent is extended or adjusted under 35 U.S.C. 154(b) by 857 days.

(21) Appl. No.: 12/245,903

(22) Filed: Oct. 6, 2008

(65) Prior Publication Data

US 2009/0101814 A1 Apr. 23, 2009

(30) Foreign Application Priority Data

Oct. 18, 2007 (IL) ..... 186740

(51) Int. Cl.
*H01J 49/00* (2006.01)

(52) U.S. Cl.
USPC ..... 250/288; 250/281; 250/282

(58) Field of Classification Search
None
See application file for complete search history.

(56) References Cited

U.S. PATENT DOCUMENTS

| | | | | |
|---|---|---|---|---|
| 4,814,612 | A * | 3/1989 | Vestal et al. | 250/288 |
| 4,960,992 | A * | 10/1990 | Vestal et al. | 250/288 |
| 5,055,677 | A * | 10/1991 | Amirav et al. | 250/282 |
| 5,347,844 | A * | 9/1994 | Grob et al. | 73/23.41 |
| 6,630,664 | B1 * | 10/2003 | Syage et al. | 250/288 |
| 7,649,171 | B1 * | 1/2010 | Freidhoff | 250/281 |
| 2003/0003595 | A1 * | 1/2003 | Amirav | 436/173 |
| 2004/0206910 | A1 * | 10/2004 | Lee et al. | 250/397 |
| 2005/0258360 | A1 * | 11/2005 | Whitehouse et al. | 250/288 |
| 2008/0087812 | A1 * | 4/2008 | Musselman | 250/285 |

* cited by examiner

*Primary Examiner* — Andrew Smyth

(57) ABSTRACT

There is provided a capillary separated vaporization chamber and nozzle method and device for improved electron ionization liquid chromatography mass spectrometry of samples in a supersonic molecular beam. The device includes a vaporization chamber located upstream of a supersonic nozzle; a capillary separating the vaporization chamber and the supersonic nozzle, means for spray formation from sample in a flowing liquid; a vacuum system into which the supersonic nozzle induces supersonic expansion of the vaporized sample compounds and solvent vapor, for forming a supersonic molecular beam with vibrationally cold sample molecules and vaporized solvent; flythrough electron ionization ion source; mass analyzer; an ion detector and means for data processing of the resulting mass spectral information, for identifying and/or quantifying the chemical content of the sample.

43 Claims, 4 Drawing Sheets

CAPILLARY SEPARATED VAPORIZATION CHAMBER AND NOZZLE DEVICE AND METHOD

FIELD OF THE INVENTION

The present invention relates to a capillary separated vaporization chamber and nozzle method and device for improved electron ionization liquid chromatography mass spectrometry of samples in a supersonic molecular beam.

BACKGROUND OF THE INVENTION

Mass spectrometry (MS) is a central analytical technology that finds a large variety of applications in a broad range of fields, especially when coupled with a chromatographic separation technique such as gas chromatography (GC) or liquid chromatography (LC). Since a growing fraction of compounds that need to be analyzed are either thermally labile or with a low volatility (low volatiles), the use of LC-MS is growing recently at a faster rate than GC-MS. However, GC-MS still possesses a major advantage over LC-MS of having an automated sample identification through the use of extensive 70 eV electron ionization (EI) libraries.

In the past, a method named particle beam was developed that enabled the combination of LC and MS with electron ionization and its associated advantage of automated library search and sample identification. The particle beam method was, however, confounded with problems of limited sensitivity, non-linear response, ion source induced peak tailing and limited range of samples amenable for analysis in view of excessive sample degradation at the ion source. In addition, standard electron ionization mass spectra suffer from a well-known "long felt need" of enhancing the relative abundance of the molecular ion which is missing or very weak in the EI mass spectra of about half of the particle beam LCL-MS sample compounds. Without having a trustworthy molecular ion, sample identification with the library cannot be trusted, in view of possible interference from homologous and degradation compounds and the identification of samples that are not included in the library, is practically precluded. Consequently, the particle beam method was phased out from the market and currently LC-MS analyses utilize almost exclusively electrospray ionization (ESI) and/or atmospheric pressure chemical ionization (APCI) for sample ionization.

Recently a method and apparatus for LC-MS has been developed which is based on spray formation and full solvent and sample vaporization before or inside a supersonic nozzle, supersonic expansion of the vaporization sample and solvent and its vibrational cooling in a supersonic molecular beam (SMB) followed by its electron ionization as cold molecules in the SMB. (A. Amirav, U.S. Pat. No. 7,247,495 and O. Granot and A. Amirav, Int. J. Mass. Spectrom. 244, 15-28 (2005)). This method has proven to be more sensitive than the particle beam, provides linear response and is compatible with an increased range of compounds in view of the elimination of sample degradation at the ion source. Most importantly, enhanced molecular ion and mass spectral information is provided due to the ionization of vibrationally cold sample molecules in the SMB. Automated library based sample identification was enabled and demonstrated with very good matching factors to the library MS in view of the feature of enhanced molecular ion combined with all the EI standard fragments. Furthermore, relatively uniform response was demonstrated to both polar and non-polar sample compounds.

This method of electron ionization LC-MS with SMB, however, suffers from a major problem (in addition to a few other problems) of poor robustness in view of too frequent clogging of the solvent delivery tube. This problem of poor robustness is further exacerbated by the need to open the vacuum chamber each time that the clogged solvent delivery tube has to be serviced or replaced, followed by lengthy cycles of pump down and MS and ion source and optics tuning.

The first and essential step in the vaporization of any flowing liquid (solution) as arriving from the LC is the formation of spray, and preferably mono-dispersed spray with small spray droplets. The standard methods of spray formation that has been used so far for sample vaporization are pneumatic assisted nebulization or thermally assisted spray and/or their combination. However, since with SMB all the added gas that is used for pneumatic assisted nebulization and spray formation is discharged into the vacuum, this mode of spray formation is considered as highly undesirable with SMB. The reason for this perception is that due to limited upper flow rate acceptance (also named "throughput") of the turbo molecular pump of the nozzle chamber, every added one ml/min gas flow rate reduces the maximum allowed LC liquid flow rate by about one micro liter/min. Thus, since the nebulization gas must be fully exhausted into the vacuum chamber, pneumatic spray that is frequently used in many other applications such as ICP-AE and ICP-MS was not used for LC-MS with SMB and thermally assisted spray was chosen instead.

The use of thermally assisted spray that is also known as Thermospray, however, requires the heating of the sample solution at the solvent delivery tube, and this heating results in frequent solvent delivery tube clogging. As the solution is heated, a portion of the sample precipitates or decomposes, particularly with concentrated solutions or when thermally labile sample compounds are analyzed which degrade, and gradually a layer of hard residue is build like limestone in a domestic kettle up to a full clogging. In addition, the output edge of the solvent delivery tube is unavoidably located inside the spray and sample vaporization tube, and this edge also suffers from a tendency to periodically clog. For this reason Thermospray was occasionally referred to in the literature as a method of "spray and pray" and this major clogging problem is reported in several publications in peer reviewed journals.

Thus, there is a major need for improved method and device for having effective electron ionization LC-MS.

SUMMARY OF THE INVENTION

It is therefore a broad purpose of the present invention to provide a method and apparatus for improved electron ionization liquid chromatography mass spectrometry.

In accordance with an embodiment of the present invention there is provided a method for introducing a sample into a supersonic molecular beam for mass spectrometry analysis using a sample vaporization chamber located upstream of a supersonic nozzle, said method comprising: directing sample compounds to be analyzed in a flowing liquid towards said vaporization chamber; forming a spray from said sample compounds in a flowing liquid; vaporization said sample compounds in said spray in said vaporization chamber prior to its expansion from said supersonic nozzle; expanding said vaporized sample compounds and solvent from said supersonic nozzle into a vacuum system, forming a supersonic molecular beam with vibrationally cold sample molecules and vaporized solvent; ionizing with electrons said sample compounds while contained as vibrationally cold molecules in said supersonic molecular beam in a fly-through electron ionization ion source; mass analyzing the ions formed from said sample compounds; detecting said ions formed from said sample compounds after mass analysis, and processing the data obtained from the resulting mass spectral information, for identifying and/or quantifying the chemical content of said sample, wherein: said sample vaporization chamber is connected to said supersonic nozzle by a capillary transfer line; said sample vaporization is completed in said vaporization chamber prior to its entry to said capillary transfer line; and said vaporized sample compounds and liquid are transferred in said capillary transfer line into said supersonic nozzle.

There is further provided a method for introducing a sample into a supersonic molecular beam for its mass spectrometry analysis comprising the steps of: directing sample compounds to be analyzed in a flowing liquid towards a vaporization chamber located upstream of a supersonic nozzle; forming a spray from said sample compounds in flowing liquid; vaporizing the sample compounds in the spray in a vaporization chamber prior to its expansion from said supersonic nozzle; expanding the vaporized sample compounds from said supersonic nozzle into a vacuum system, forming a supersonic molecular beam with vibrationally cold sample molecules and vaporized solvent; ionizing with electrons the sample compounds while contained as vibrationally cold molecules in said supersonic molecular beam in a fly-through electron ionization ion source; mass analyzing the ions formed from said sample compounds; detecting the ions formed from said sample compounds after mass analysis, and processing the data obtained from the resulting mass spectral information, for identifying and/or quantifying the chemical content of said sample, wherein the spray formation for sample compounds vaporization prior to its expansion from said supersonic nozzle is performed with electrospray.

The invention still further provides a device for introducing a sample in a flowing liquid into a supersonic molecular beam for its mass spectrometry analysis, comprising: a vaporization chamber located upstream of a supersonic nozzle; a capillary separating the vaporization chamber and said supersonic nozzle; means for spray formation from said sample in the flowing liquid; a vacuum system into which said supersonic nozzle induces supersonic expansion of the vaporized sample compounds and solvent vapor, for forming a supersonic molecular beam with vibrationally cold sample molecules and vaporized solvent; a fly-through electron ionization ion source for the ionization of said sample compounds while contained, as vibrationally cold molecules, in said supersonic molecular beam; a mass analyzer for mass analysis of ions formed from the sample compounds in said fly-through ion source; an ion detector for the detection of said ions formed from said sample compounds after mass analysis, and means for data processing of the resulting mass spectral information, for identifying and/or quantifying the chemical content of said sample.

The invention yet further provides a device for introducing a sample into a supersonic molecular beam for its mass spectrometry analysis comprising: liquid transfer line means for directing sample compounds to be analyzed in a flowing liquid towards a supersonic nozzle; electrospray for spray formation from said sample in said flowing liquid; a spray and sample vaporization chamber for vaporizing said sample compounds in said spray prior to its expansion from said supersonic nozzle; a supersonic nozzle for inducing supersonic expansion of said vaporized sample compounds and solvent vapor into a vacuum system, forming a supersonic molecular beam with vibrationally cold sample molecules and vaporized solvent; a fly-through electron ionization ion source for the ionization of said sample compounds while contained as vibrationally cold molecules in said supersonic molecular beam; a mass analyzer for mass analysis of the ions formed from said sample compounds in said fly-through ion source; an ion detector for the detection of said ions formed from said sample compounds after mass analysis, and means for data processing of the resulting mass spectral information, for identifying and/or quantifying the chemical content of said sample.

BRIEF DESCRIPTION OF THE DRAWINGS

In order to understand the invention and to see how it may be carried out in practice, some embodiments will now be described, by way of non-limiting example only, with reference to the following illustrative figures, wherein.

PROBLEMS ADDRESSED BY THE INVENTION

Figure 1:
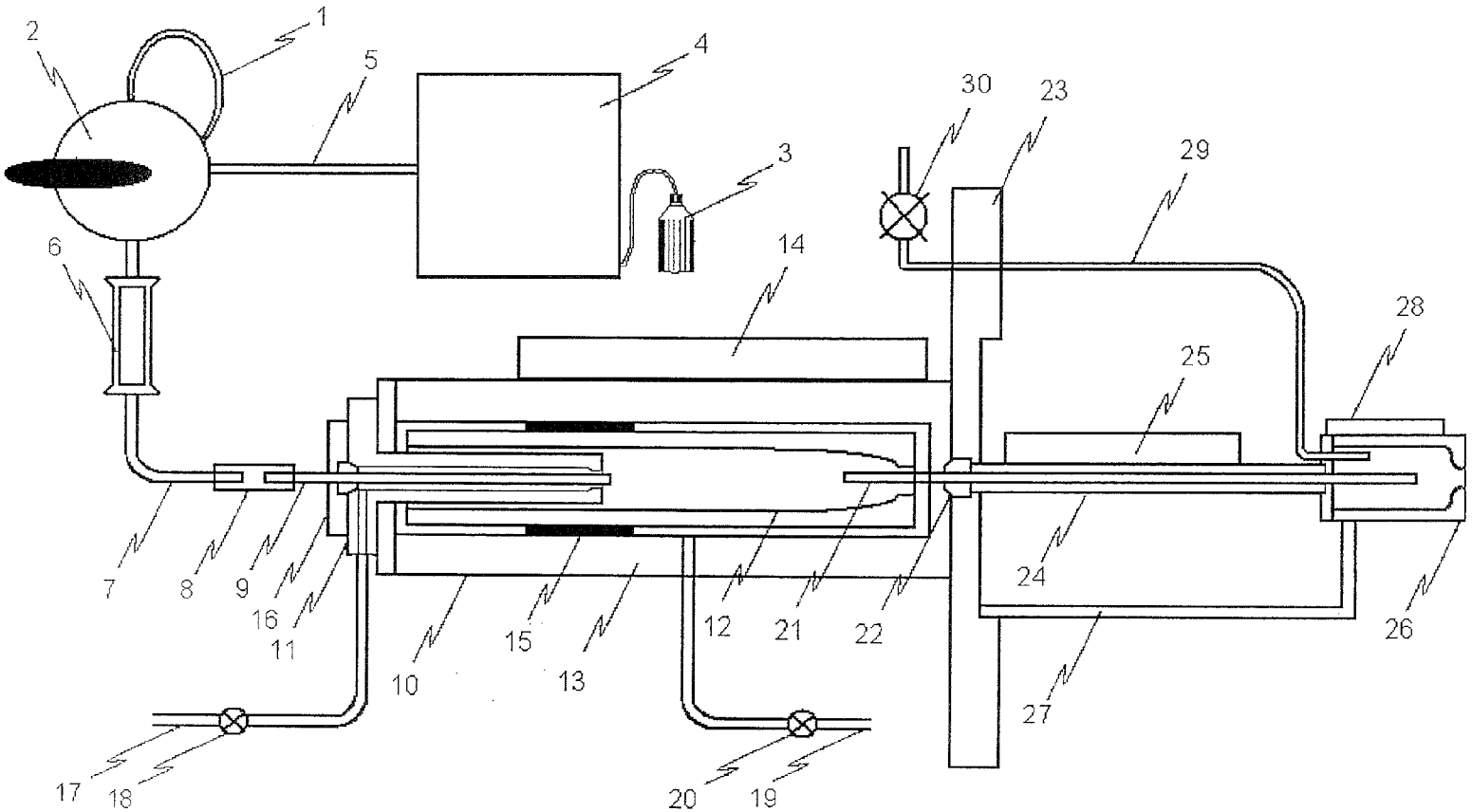
FIG. 1 is a schematic diagram illustrating the capillary separated vaporization chamber and nozzle device, according to an embodiment of the present invention.

At the heart of the current LC-MS with SMB method is the use of a relatively large diameter nozzle to solve the central problem of cluster formation of sample compounds with solvent molecules in view of the super-cooling conditions at the supersonic expansion. Thus, the nozzle diameter must be sufficiently large to eliminate post expansion cluster formation, yet small enough to enable effective vibrational cooling. Cluster formation of the sample with the solvent molecules depends on three body collisions, hence on $P^3D$, while the vibrational cooling depends on PD, where P is the pressure behind the nozzle and D is the nozzle diameter. Thus, for a given liquid solution flow rate, the doubling of the nozzle diameter leads to the reduction of the vaporized solvent pressure by a factor of 4 hence to the reduction of cluster formation by a factor of 32. Meanwhile, such doubling of the nozzle diameter has only a minor factor of two penalty on the efficiency of vibrational cooling, that is far superior to that of pure helium in view of methanol or water being a heavier molecule without velocity slip. Consequently, a relatively large nozzle with 0.32 mm I.D. is typically used in order to reduce the pressure of vaporized solvent behind the nozzle to less than 0.1 Bar. With such essential relatively low nozzle backing pressure cluster formation is minimized and good EI mass spectra of vibrationally cold sample molecules is obtained.

The mandatory use of this existing EI LC-MS with SMB concept with its sub-ambient nozzle backing pressure, however, has several downsides and disadvantages that significantly reduce the merit of EI LC-MS with SMB including:

A) Low vaporization efficiency. The sample emerges in a thermally assisted spray from its liquid delivery capillary tubing at almost sonic velocity due to ~1000 fold liquid expansion upon its vaporization. Before droplet and sample vaporization, the droplet must be stopped or significantly decelerated, vaporized and then the small sample particle that is inevitably produced from the dried droplet has to be fully vaporized. This dual stage vaporization process requires many collisions between the sample particle and solvent vapor during the limited time that the sample stays at the vaporization chamber and nozzle before its expansion from the supersonic nozzle. For sample compounds with relatively low volatility, however, the collision rate at the relatively low pressure behind the nozzle is too slow to stop the solvent droplet and vaporize the sample from its particle, and as a result, most of the sample is expanded without vaporization and is thus lost and not detected. This problem is very severe with polystyrene Oligomers and other relatively large (low volatility) compounds. It has been found that the increase of the nozzle backing pressure, for example by the reduction of the nozzle diameter, more than linearly improves sample vaporization but it is combined with a penalty in the formation of clusters that reduced the signal, complicate the mass spectra and impeded the use of libraries for identification. There is thus a clear need to increase the pressure at the vaporization chamber without an increase of the pressure downstream at the nozzle.

B) The need for some added gas flow and the desire for pneumatic spray. It has been found that upon spray vaporization, a portion of the spray droplets and vaporized sample migrates backward despite the assumed pressure gradient towards the nozzle which is connected to the vacuum system. The reason for this unexpected and surprising back scattering is that the sudden spray droplet vaporization forms a standing pressure wave and elevated pressure zone at the middle of the vaporization chamber. It has also been found that some areas in the vaporization chamber are not properly flushed and serve as "dead volumes" that can induce peak tailing and degradation. Thus, the addition of some forward gas flow is highly desirable despite its adverse affect on the maximum allowable liquid flow rate. As a result, the use of limited gas flow rate is needed in order to serve as a dynamic seal to prevent the back scattering motion of sample compounds that can result in peak tailing and increased noise. However, each ml/min gas flow rate results in the reduction of about one μl/mm LC liquid flow rate in view of the fact that all the gas and vaporized solvent expand into the vacuum system that is pumped by a turbo molecular pump with a limited maximum throughput. There is thus a clear need to be able to add gas flow without a penalty on the limited upper LC liquid flow rate.

C) The need for easy service without opening of the vacuum. Since the thermal vaporization unit terminates with a supersonic nozzle, the latter is located inside the vacuum system, any case of liquid transfer line clogging requires venting and opening of the vacuum system and its pumping down after the replacement of the solvent delivery tube and the returning of the whole MS system as commonly employed with MS systems after venting. Thus, the possible use of vaporization chamber at above atmospheric pressure, at least for service, is desirable for easy service despite any possible associated cluster formation problems.

D) The use of helium as a spray gas. The use of pneumatic spray can solve some or most of the problems of thermally assisted spray. However, additional perceived problems of pneumatic spray are that in view of the large volume of nebulization gas that is used, some of this gas and vaporized solvent and sample must be flushed out like in a split injector of a gas chromatograph, and such gas splitting requires the operation of the vaporization chamber at above atmospheric pressures. It has been found by the present inventor that surprisingly the replacement of a portion of the LC liquid with sample by helium can result in negligible signal loss and even with the very surprising and counter intuitive result of signal increase despite the reduction in the amount of sample at the SMB. The explanation of this increased signal with reduced amount of sample is that the amount of solvent vapor is also reduced and thus, the adverse effects of solvent molecules scattering from the sample after their supersonic expansion and before the skimmer and its forming of increased space charge at the ion source are also reduced. In addition, the magnitude of jet separation sample focusing at the center of the beam is improved by the replacement of solvent vapor with light helium atoms and the process of vacuum background filtration is also improved in view of sample acceleration with helium. Sample acceleration is also beneficial for the reduction of collision induced scattering loses with the solvent molecules. Thus, it is now realized that one can use helium as a nebulizing gas without suffering from split losses if a portion of the vaporized sample and solvent are vented.

E) The need for low temperature slow vaporization. In the past (for example, U.S. Pat. No. 7,247,495) it was thought that the faster the vaporization, the better it is in terms of reducing the time available for sample decomposition. As a result, ultra fast sample vaporization during its near sonic velocity motion inside channel nozzles was used and such fast vaporization requires very high nozzle vaporizer temperatures (such as above 500° C.) due to limited heat transfer rate considerations. It has been found experimentally by the present inventor that surprisingly the opposite is true for the preservation of thermally labile compounds, namely, that it is better to have slow vaporization at lower temperatures than faster vaporization at higher temperatures. The reason for this counter intuitive conclusion is that the activation energy for sample degradation is usually higher than for sample vaporization. Consequently, the required high temperature vaporization has a more pronounced exponential effect on the rate of sample degradation than the linear gain in such sample decomposition, due to the reduction of time available for degradation. Consequently, a vaporization chamber with relatively large volume is required to prolong the sample vaporization time that as a result could be performed at lower temperatures. For a typical sample such as aldicarb, it has been determined that every 20 degrees of higher vaporization chamber temperature reduces the time spent by this compound as absorbed on the walls, by a factor of two, but increases the rate of aldicarb degradation to aldicarbnitrile by a factor of 5, and thus promotes increased degradation. It thus emerges that the vaporization chamber should be relatively large for relatively low temperature slow vaporization, up to the limit of peak broadening by too slow sample flushing and evacuation.

DETAILED DESCRIPTION OF THE INVENTION

In order to address the requirements above, eliminate the major adverse problem of solvent delivery tube clogging and improve the process of sample vaporization from a steady flow of liquid, one must eliminate or reduce the use of thermally assisted spray as much as possible and use alternative methods of spray formation for sample vaporization prior to its nozzle expansion. Preferably the spray should be achieved with minimal heat load on the solvent delivery tube.

Illustrated in FIG. 1 is a schematic diagram of a capillary separated vaporization chamber and nozzle device according to the present invention. The sample is introduced into the sample loop 1 that is located on the flow injection valve 2. Solvent is pumped from the solvent container 3 by the LC pump 4 into solvent delivery tube 5 and sweeps the sample from its loop 1 into the LC column 6 for the separation of the sample compounds in time as normally achieved with LC analysis. The LC column 6 can be eliminated if no separation is needed and faster flow injection MS analysis can replace the time consuming LC-MS analysis. The sample is eluted from the LC column 6 output into solvent delivery tube 7 and enters union 8 which also connects solvent delivery tube 9 that is adapted to bring a steady flow of liquid solution with the sample for its nebulization, spray formation and vaporization in the vaporization chamber 10 which is equipped with a pneumatic sprayer element 11. The spray formation and sample vaporization is performed inside a deactivated glass (or fused silica) liner 12 that is located inside a heated block 13 that is heated by heater element 14. The solvent delivery tube entrance region is not directly heated to reduce the heat load on the solvent delivery tube. The liner 12 is sealed by internal seal 15, and the solvent delivery tube 7 is sealed by another clamped ferrule 16. Thus, the nebulizing gas that is provided from tubing 17 through the flow regulating (control) valve 18 must flow through the liner 12 from left to right through its pneumatic sprayer element 16, and exit either through the split flow output tube 19 with split flow regulation via valve 20 and/or through the capillary transfer line 21. The vaporized sample, which is typically at above one atmosphere pressure, flows through capillary transfer line 21 sealed by ferrule seal 22, located and clamped by the vacuum chamber flange 23. The capillary transfer line 21 which serves for the transfer of vaporized sample, solvent vapor and nebulizing gas and its guiding structural element 24, are separately heated by heater element 25 and the vaporized sample, solvent vapor and nebulizing gas exit the capillary transfer line 21 in front of (upstream) a supersonic nozzle 26 that is held by a nozzle mounting block 27 characterized by low heat conductivity and it is separately heated by a nozzle heater 28. Additional make up gas can be provided through a gas tube 29 to the nozzle 26. The make up gas flow-rate is regulated by a valve or an electronic flow control 30. The vacuum chamber flange 23 can be located on an adjustable XY table for optimal positioning of the nozzle in front of a skimmer (not shown). The sample compounds together with nebulizing gas, added nozzle make up gas and solvent vapor expand from the supersonic nozzle 26 into a vacuum chamber, while being vibrationally cooled, skimmed, collimated into a seeded supersonic molecular beam that contains the sample compounds and ionized by electron impact in a fly-through ion source, followed by sample ions mass analysis and data processing for sample identification and quantification.

The unique and novel element of the device that is described in FIG. 1 is the vaporized sample capillary transfer line 21. This capillary transfer line 21 is typically made from a Vespel coated deactivated fused silica capillary, which are widely used in gas chromatography as transfer lines and are commercially available. The internal diameters are in the range of 100 μm, 150 μm, 180 μm, 200 μm, 220 μm, 250 μm, 320 μm and 530 μm, with appropriate ferrule seals. These capillaries are relatively flexible, can be easily bent and be heated to 400° C. or with a flexible aluminum coating to 600° C. Recently, thin flexible metal tubing with internal diameters of 280 μm, 450 μm, and 530 μm became commercially available and they are internally deactivated with thin fused silica deactivation layer and can be conveniently heated by direct resistive heating. The main purpose of this capillary, which physically separates between the vaporization chamber and supersonic nozzle, is to serve as a flow restrictor (flow impedance) element while transferring the sample vapor into the nozzle for supersonic expansion. As a result, the pressure behind the nozzle is separately and independently adjusted by its diameter and flow through the capillary transfer line to be about 0.1 Atmosphere, in a compromise value as required to obtain good vibrational cooling yet with clean mass spectra without cluster formation mass spectral complications. In addition, make up gas such as helium can be added for better control of the total gas flow rate through the nozzle and improved sample vibrational cooling, particularly when low liquid flow rates are used. The nozzle temperature can be separately controlled while being thermally insulated and unaffected by the temperature of the vaporization chamber. Thus, the nozzle is typically (particularly when low volatility samples are analyzed) cooler than the vaporization chamber that is required to vaporize the spray and sample in finite time. On the other hand, the pressure at the spray formation and sample vaporization chamber is adjusted by the capillary transfer line flow impedance to be at an operational pressure about 1 Atmosphere for optimal sample vaporization, increased robustness and easier maintenance. The capillary transfer line flow impedance is adjusted in consideration with the desired sample and vaporized solvent flow rate, and the main parameters that are controlled are the capillary tube length (linear flow impedance dependence) and its internal diameter ($1/D^4$ flow impedance dependence) while the temperature and solvent vapor viscosity are additional secondary parameters for consideration according to the Poiseuille equation. In addition to a choice of internal diameters, one can use two such capillaries connected in series by a union to obtain practically any chosen flow impedance.

At first sight it seems that the addition of another element in the form of heated capillary transfer line to the vaporization chamber and nozzle, which physically separates them, only complicates the sample vaporization chamber and nozzle combination, and adds nothing but an unneeded third heater and its control, resulting in increased size, length and cost of the device and further increasing the residence time of the sample after its vaporization and as a result its chances of degradation.

As will be shown below, however, the addition of this capillary tubing flow restrictor element provides an impressive range of advantages that far outweighs its added cost and complexity, and in fact, the danger of sample degradation is not only not increased but is actually reduced.

The capillary separated vaporization chamber and nozzle method and device according to the present invention and as shown in FIG. 1 enable significantly improved electron ionization liquid chromatography mass spectrometry for the following ten reasons:

A) Improved robustness. The use of spray formation and sample vaporization at pressures above ambient allow for the use of easy vapor splitting to the open air (optionally through a trap). As a result, the use of unrestricted nebulizing gas flow rate is enabled for effective pneumatic assisted spray, without direct trade off of upper LC liquid flow rate and added nebulizing gas. This feature emerges from the fact that with the capillary separated vaporization chamber and nozzle device, the vacuum pump can accept the solvent and gas load according to its throughput limit while the access load is vented outside the vaporization chamber at ambient pressure. As a result, there is no longer a requirement for the exclusive use of thermally assisted spray and the much more robust pneumatic assisted spray can be used. Another interesting feature is that the pneumatic nebulizer which is inserted into the vaporization chamber liner can be made from heat conductive aluminum alloy and be air-cooled by having a portion of it exposed to the room air (with or without forced air-cooling). Accordingly, the liquid solvent delivery tube will undergo a large temperature gradient for minimal contribution of heat load induced detrimental thermally assisted spray.

B) Electrospray vaporization. Electrospray is another type of spray formation which is widely used in LC-MS for sample ionization. Electrospray requires atmospheric or high pressures since at reduced pressures the high electrospray needle voltage promotes arcs and discharges. Since electrospray is an effective way for obtaining fine spray formation it can also be used for effective sample vaporization after the electrospray and before sample expansion as neutral sample compounds for its electron ionization.

C) Easy service. In addition to improved robustness, since the flow impedance of the added capillary is adjusted to withstand vaporized LC solvent flow rate that creates above atmospheric pressure, it can also withstand the restricted/limited air flow rate through the capillary when it is open to ambient air. As a result, service to the vaporization chamber is easy and even if the solvent delivery tube is clogged its replacement, if needed, is simple, fast and does not require venting of the MS vacuum chamber. The same applies to the liner that becomes periodically dirty and requires cleaning or replacement, which is now simple and fast due to the added capillary transfer line. Furthermore, since the liner serves only for vaporization and does not end with a nozzle, with proper design of the capillary separated vaporization chamber and nozzle device one can choose an optimized liner among the large variety and shapes of commercially available GC injector liners.

D) Extended flow rate and added split capability without lost sensitivity. Vaporization chamber operation at above atmospheric pressure enables easy flow splitting. Thus, high LC column flow rate can be explored without overloading the vacuum pump, even with a relatively small and low cost pump. The use of helium (or hydrogen) as a spray gas more than compensates for any sample and solvent that is lost at the split output in view of significantly increased sample ionization efficiency upon its expansion with helium. Such use of helium is resulting in improved jet separation, reduced scattering losses as neutrals and as ions, reduced space charge effects at the ion source and improved vacuum background filtration. Thus, split-related losses are avoided and the sensitivity can even be improved or remain practically split-independent when helium is used as the nebulizing gas. In addition, the reduced sample amount at the vacuum system helps to prolong the lifetime of the turbo molecular pump whose bearing can be clogged by certain samples such as polystyrene Oligomers. Hydrogen could be an even better nebulizing gas but its use requires special safety precautions and a special turbo molecular pump with adequate compression ratio.

E) Improved sample vaporization and increased range of compounds, amenable for analysis. At the higher vaporization chamber pressure, the frequency of vaporizing collisions is increased by more than an order of magnitude in comparison with 0.1 Bar. Furthermore, the spray droplets, sample particles and sample vapor residence time at the vaporization chamber liner is also linearly increased with the pressure since for a given total gas flux the gas velocity is inversely proportional to its pressure. Thus, increased pressure at the vaporization chamber from 0.1 Bar to 2 Bars results in about 400 times more vaporizing scattering collisions with the nebulization gas and solvent vapor. As a result, the spray droplets are stopped as in GC injectors in less than one cm and the created sample particles can be effectively evaporated by the high frequency vaporizing collisions with the solvent vapor at above ambient pressure. Consequently, an increased range of low volatility sample compounds can be vaporized.

F) Softer sample vaporization. The physical separation of the nozzle from the vaporization chamber by a long and separately heated capillary transfer line enables effective separate temperature control of each of these elements since now they are properly thermally insulated one from the other. Thus, the nozzle temperature can be held at its optimal temperature for good cooling yet without cluster formation while the vaporization chamber can be at a higher temperature as required for sample vaporization, and the capillary transfer line should be at its own suitable temperature for fast tailing free sample transfer. An important, yet unexpected, finding was that in contrast to previous perception, softer sample vaporization can be achieved with longer vaporization chamber residence times at lower temperatures since the lower temperature has an exponential effect on the reduction of sample degradation while the degradation time has only a linear effect on increased degradation. Thus, the fact that the vaporization chamber pressure is increased (and the liner diameter and volume is also increased) about twenty times correspondingly increases the sample spray, particle and vapor residence time at the vaporization chamber and allows the use of a significantly cooler vaporization chamber by about 100-200° C. with the positive end result of softer thermal vaporization of thermally labile sample compounds. Due to this radical change and turnaround of our understanding regarding the sample vaporization process, ultra fast sample vaporization inside the channel nozzle at sonic gas velocity is no longer mandatory. According to the present invention and in contrast to prior teaching, sample vaporization is performed using much bigger vaporization chambers hence with much slower gas and vapor motion velocity at higher pressures. The capillary transfer line according to the present invention serves as a flow impedance element between the vaporization chamber and nozzle, acts as a transfer line and does not participate in the process of sample vaporization. In addition, the thermal separation of the vaporization chamber and nozzle allows their independent temperature control and programming for achieving softer, time programmed vaporization, so that relatively volatile samples can be vaporized at lower temperatures than low volatility samples.

G) Improved sensitivity. The physical separation of the nozzle from the vaporization chamber means that the nozzle can be separately machined for optimal nozzle shape and maintained at optimal nozzle temperature for improved sensitivity. The conventional combined vaporization chamber and nozzle is typically made from one piece of fused silica tubing due to the combination of inertness and high temperature requirements of the vaporization chamber hence the nozzle in such known systems is also made from fused silica. According to the present invention, the nozzle can also be made from machined ceramic or Vespel high temperature plastic and thus have any desirable shape for optimized sensitivity which may depend on experimental conditions such as solvent type, flow rate and helium make up gas flow rate.

H) Flexible location of the vaporization chamber. One of the surprisingly beneficial features of the capillary separated vaporization chamber and nozzle device is that the length of the capillary is not important up to unexpectedly large lengths. The main reason for this is that since the capillary diameter is typically less than 10% of that of the vaporization chamber liner (typically 0.32 mm capillary ID verses 3-4 mm vaporization chamber liner ID respectively), the velocity of the solvent vapor and sample is about 200 times faster in the capillary than in the vaporization liner (a further factor of 2 emerges from the fact that the average pressure in the capillary is reduced by a factor of 2). Thus, even if the capillary is 20 times longer than the effective length of the vaporization chamber liner length which is typically 5 cm, sample degradation in it is negligible. Furthermore, the liner temperature must be hotter than the optimal capillary transfer line temperature in order to promote and enhance sample vaporization from solvent droplets and sample particles and thus, sample degradation if it occurs is likely to happen at the vaporization liner and not at the capillary transfer line even if the latter has a length of 1 meter. Thus, relatively long capillary transfer lines such as up to one meter can safely be used, which results in significantly greater flexibility in the location of the vaporization chamber which as described below, is a valuable feature. Vespel coated fused silica capillaries can be placed inside stainless steel tubes and be conveniently heated by direct current heating while retaining their shape flexibility as practiced in several gas chromatographs. If long capillaries are desirable, in order to reduce their flow impedance larger internal diameters can be used such as 0.53 mm. A capillary with 0.53 mm ID has 7.5 times lower flow impedance than that of 0.32 mm ID capillary and can thus be 7.5 times longer for the same flow impedance.

I) Combined electron ionization GC-ML and LC-MS in a unified MS system. For many applications such as service MS and small laboratories there is a clear benefit in having a single mass spectrometer system that can be operated either as GC-MS or LC-MS. Such a unified system saves cost, space and maintenance from its operator. The use of electron ionization for both GC-MS and LC-MS is unique in the provision of a unified MS system that can be used for both applications. The use of a flexible capillary tube to separate the nozzle from the LC providing flow of solution with sample for its vaporization in a vaporization chamber results in an elegant solution for a combined system in which the nozzle can accept samples from two such capillary transfer lines, one that comes from the GC and one from the LC. Thus, in addition to having two systems in a single MS platform, such systems can be characterized by having the ability to switch between the two modes of GC-MS and LC-MS operation without any change of hardware, simply by selection of appropriate control software via a suitable user interface on the control computer.

J) Sample vaporization chamber location on a gas chromatography Since the use of the capillary transfer line provides flexible location of the vaporization chamber, it can be located on a gas chromatograph in place of one of its injectors. In addition, the GC injector itself can be slightly modified and serve for LC sample vaporization, since it shares many of the needed features to enable effective sample vaporization from a flow of a solution. The major difference is that the GC injector is designed for sample vaporization from a pulse of liquid, while according to the present invention it must be modified for sample vaporization from a steady flow of liquid. Such a location of the vaporization chamber on a GC can provide an elegant and low-cost solution for the location of the vaporization chamber and enables alternate GC-MS and LC-MS analysis using two different injectors, without any change of hardware, simply by selection of appropriate control software via a suitable user interface on the control computer.

The combination of these ten advantageous and unique features in the method and device of capillary separated vaporization chamber and nozzle, transforms electron ionization LC-MS with SMB into a valuable and useful tool for broad range of LC-MS applications.

In accordance with the invention, there is also provided a spray method that does not require heat or gas which is electrospray. In electrospray, a syringe like needle is charged to about 3-5 KV, and if it is located close to a grounded metallic object, the liquid that flows from this needle spontaneously forms a spray that is known as electrospray. This type of spray finds widespread utilization in the ionization of samples for its mass analysis in IC-MS systems. However, unique to this novel method and device is the utilization of the electrospray for potentially heat and gas-free spray formation for its further full thermal vaporization in an inert chamber. The vaporized sample and solvent expand from a supersonic nozzle and form a supersonic molecular beam and then the vibrationally cold neutral sample compounds are ionized by electrons and are mass analyzed for sample identification and quantitative determination.

Figure 2:
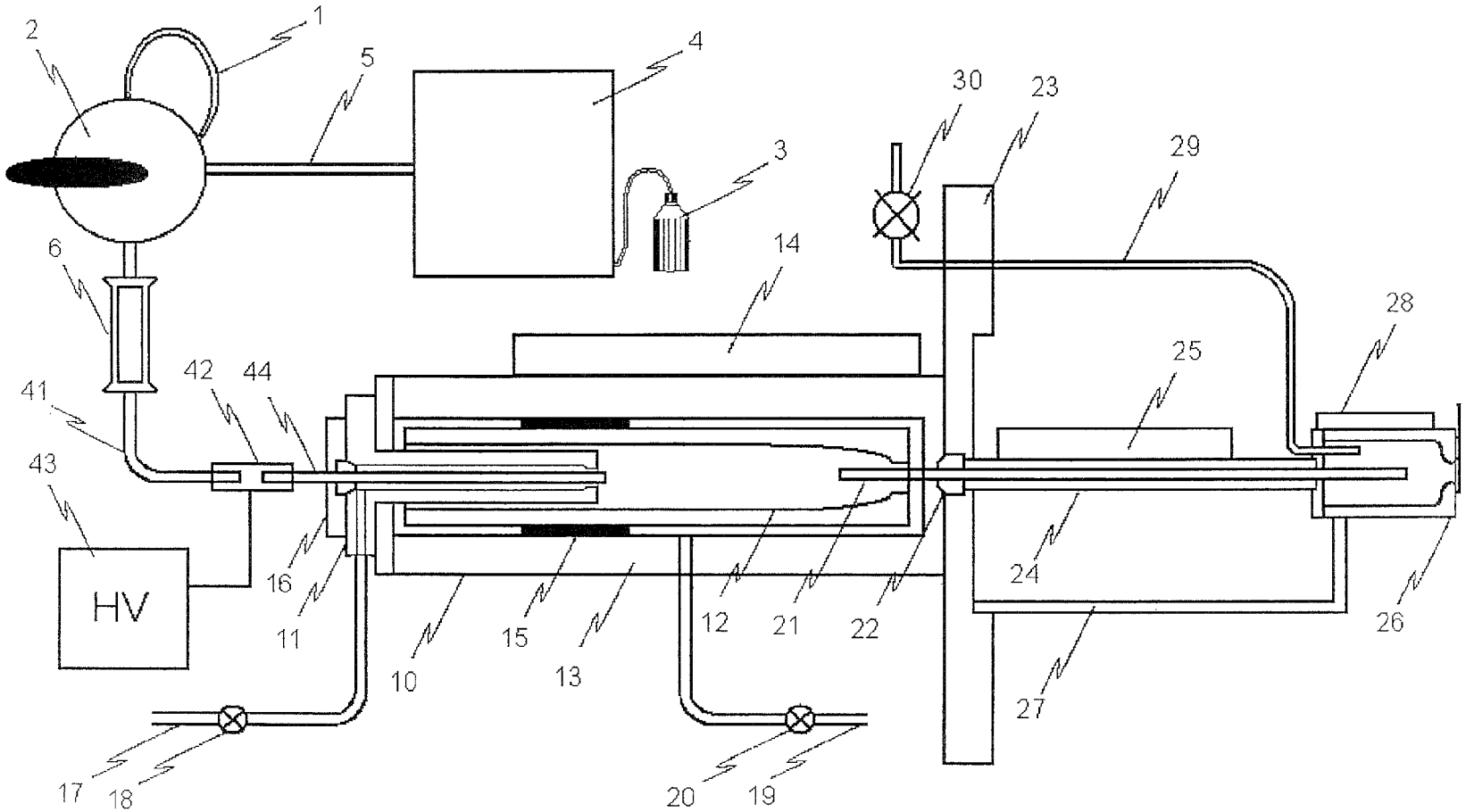
FIG. 2 is a schematic diagram illustrating the capillary separated vaporization chamber and nozzle device which is operated with electrospray for electrospray assisted sample vaporization.

In FIG. 2 this electrospray-based sample vaporization and nozzle device is schematically shown. The sample is eluted from the output of the LC column into a solvent delivery tube 41 which, for compatibility with the electrospray, is made from non-conducting materials such as Peek or Vespel-coated fused silica. The flow of the sample which is the output of the LC, enters union 42 which, for compatibility with the electrospray is typically made from an inert metal and with minimal dead volume, yet with some contact of the flowing liquid with the inner metal surface for charging the flowing liquid. Union 42 also connects solvent delivery tube 44, which can be made either from conductive (metal) or non-conductive material that is adapted to provide a steady flow of liquid solution with the sample for its electrospray formation and vaporization in the vaporization chamber. A high voltage power supply 43 is connected to union 42 and upon the charging of the union 42 to 3-5 KV, an electrospray spontaneously forms at the end of tube 44 inside the vaporization chamber. In order to obtain the electrospray, the tube 44 must face a counter electrode to bring to ground the electrospray charges. Heated glass liner above 200° C. acts as a semiconductor and their limited electrical conductivity is sufficient to enable the electrospray. Thus, the glass liner of the vaporization chamber can also serve as a counter electrode for the electrospray. If the tube 44 is made from a metal, it should be electrically insulated from the ferrule seal and its clamp and the pneumatic spray. While the pneumatic nebulization element can remain for enabling pneumatic assisted electrospray, the required gas flow rate is significantly lower for having a good spray than with pure pneumatic spray without the electrospray voltage.

The spray formation and sample vaporization is typically performed inside a deactivated heated glass (or fused silica) liner that is located inside a heated block 13 as in FIG. 1. This method is different from other electrospray methods in that:

A) Electrospray is used for spray formation and sample vaporization and not for ionization.

B) The electrospray is typically performed inside insert glass or fused silica liner than must be heated in order to conduct electricity and avoid wall charging.

C) The electrospray is preferably performed from a fused silica liquid transfer line and not from a metallic syringe like needle and this feature requires the use of metallic union for the remote charging of the sample solution.

An additional feature of the present invention is that in view of the capillary flow impedance that separates the electrospray and vaporization chamber from the nozzle, the electrospray is performed at above or near atmospheric pressures and not at low pressures such as 0.1 Bar. Low pressure electrospray is difficult to obtain since, as the pressure is reduced, the high voltage of the electrospray needle tends to promote arcing and discharge that require higher pressure for its elimination as provided by the flow impedance of the capillary. In addition, the charged droplets moving at 0.1 Bar are directed to the sides, towards the glass liner walls and the spray quality is much poorer. Furthermore, as described above, the electrospray process of spray formation is only the first step that must be followed by full spray and its resulting sample particle vaporization, which significantly benefits from the use of the capillary separated vaporization and nozzle device.

The combination of electrospray for sample vaporization and EI LC-MS with SMB provides the following important advantages:

1. Improved robustness. Since electrospray can be used without any heat, the system robustness is improved and clogging of the solvent delivery tube is practically eliminated.

2. Improved vaporization and inertness. Since electrospray forms very fine droplets, after its vaporization smaller sample particles can be formed that can be further gently vaporized with reduced degradation.

3. Improved vaporization of large molecules. Electrospray is a unique form of spray in that sample compounds can be ejected from its spray droplets as charged ions without any heat, even if these are very large sample compounds, including peptides, proteins, polymers etc. As a result, if these ions will be later neutralized on a wall or through charge exchange with the solvent droplets or with added doping compounds, electrospray can potentially serve for heat-free generation of record large sample compounds for their supersonic expansion, electron ionization and mass analysis.

4. Easier combination of conversion to electrospray as an ionization method. The capillary tubing that connects the vaporization chamber and nozzle resembles in some ways standard electrospray ionization ion funnels. Thus, if the nozzle is removed and an additional vacuum chamber added, ions that are formed and transported through the capillary can be analyzed as in electrospray ionization for having a combined EI and ESI ionization methods in a one system.

Currently LC-MS and GC-MS are used with separate specific systems. The main reason for this situation is that GC-MS is based on the use of electron ionization (EI) ion source which is located inside the vacuum system while LC-MS uses predominantly electrospray ionization (ESI) and atmospheric pressure chemical ionization (APCI), which are both atmospheric pressure ionization methods. In both ESI and APCI the ion source is located at ambient pressure and the ions are transferred into the MS with a special ion funnel, and through gas expansion vacuum chamber and RF only multi-pole ion optics and lens systems. As a result, EI and ESI/APCI are incompatible and the design of dual use system is not practical hence not available.

However, there is a long felt clear need in having a one MS system that could be used as either GC-MS or LC-MS. Furthermore, such system should preferably be converted from one mode of operation to another without any change of hardware, simply by a click of the mouse change of method. LC-MS in combination with EI with SMB is unique in having the same ion source that is used for GC-MS with SMB. Thus, in principle, the same MS system could be used for both EI LC-MS with SMB and GC-MS with SMB. On the other hand, several of the features of the system such as its vacuum pumps are not necessarily identical and having the same MS system capable of alternate GC-MS and LC-EI-MS analysis is a challenge that is among the targets of this invention.

Figure 3:
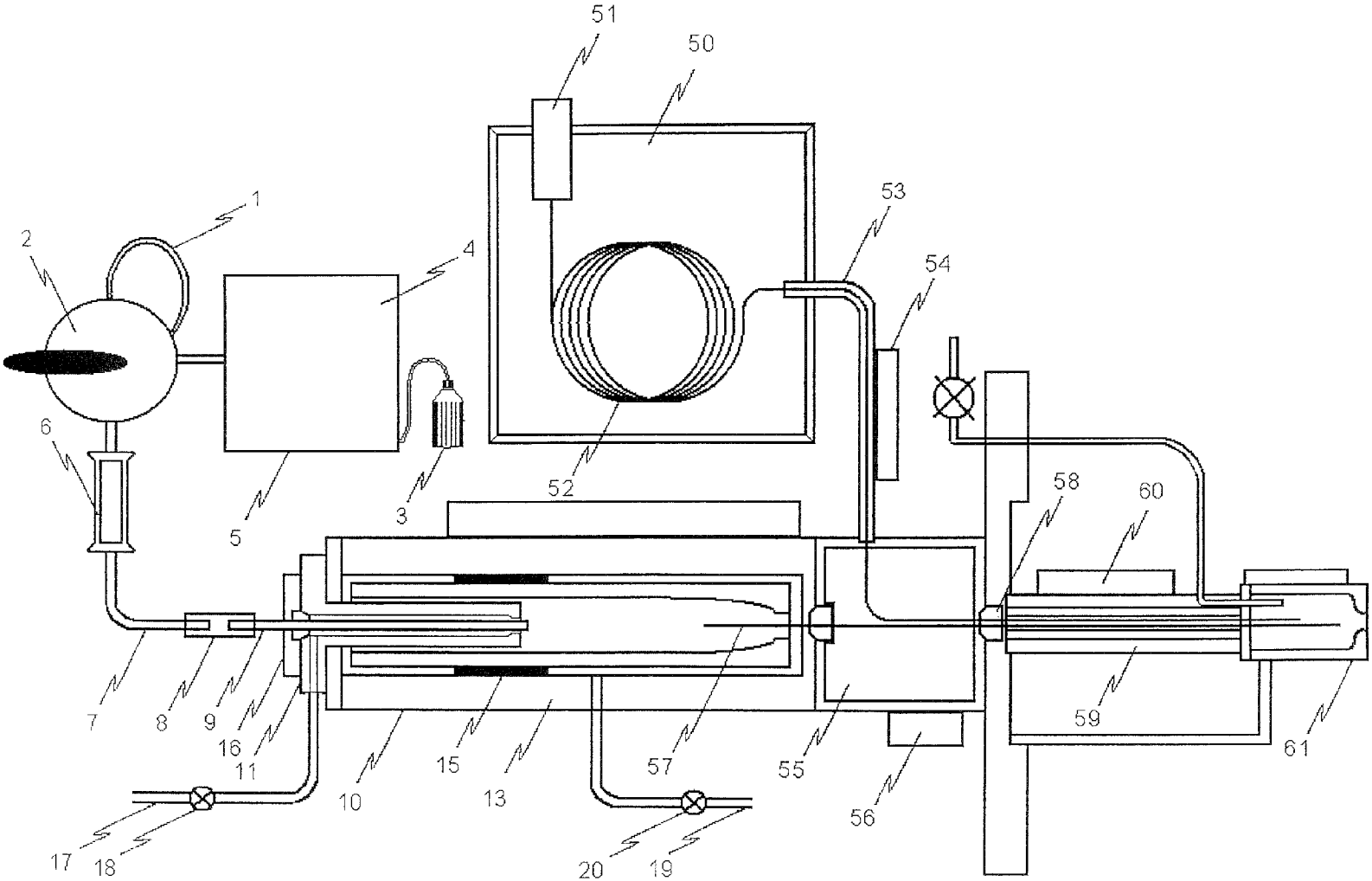
FIG. 3 is a schematic diagram illustrating a modification of the device of FIG. 1 according to the present invention.

In FIG. 3 a schematic diagram of another version of the capillary separated vaporization chamber and nozzle device is shown, aimed at obtaining alternate LC-MS and GC-MS analysis. A sample can be injected into GC 50 through the GC standard injector 51 for its separation in time in a GC column 52. The GC sample enters a GC heated transfer line 53, which is heated and temperature-controlled by a heater 54. The GC heated transfer line 53 ends at an LC and GC unified interface box 55, which is heated by a heater 56. Both the GC column 52 and the LC vaporized sample capillary transfer line 57 are directed through a dual holes ferrule 58 into their guiding structural element 59 that is separately heated by a heater element 60, and the vaporized sample from either the GC and/or the LC is transferred to a supersonic nozzle 61 for its further analysis, as described with reference to FIG. 1.

Figure 4:
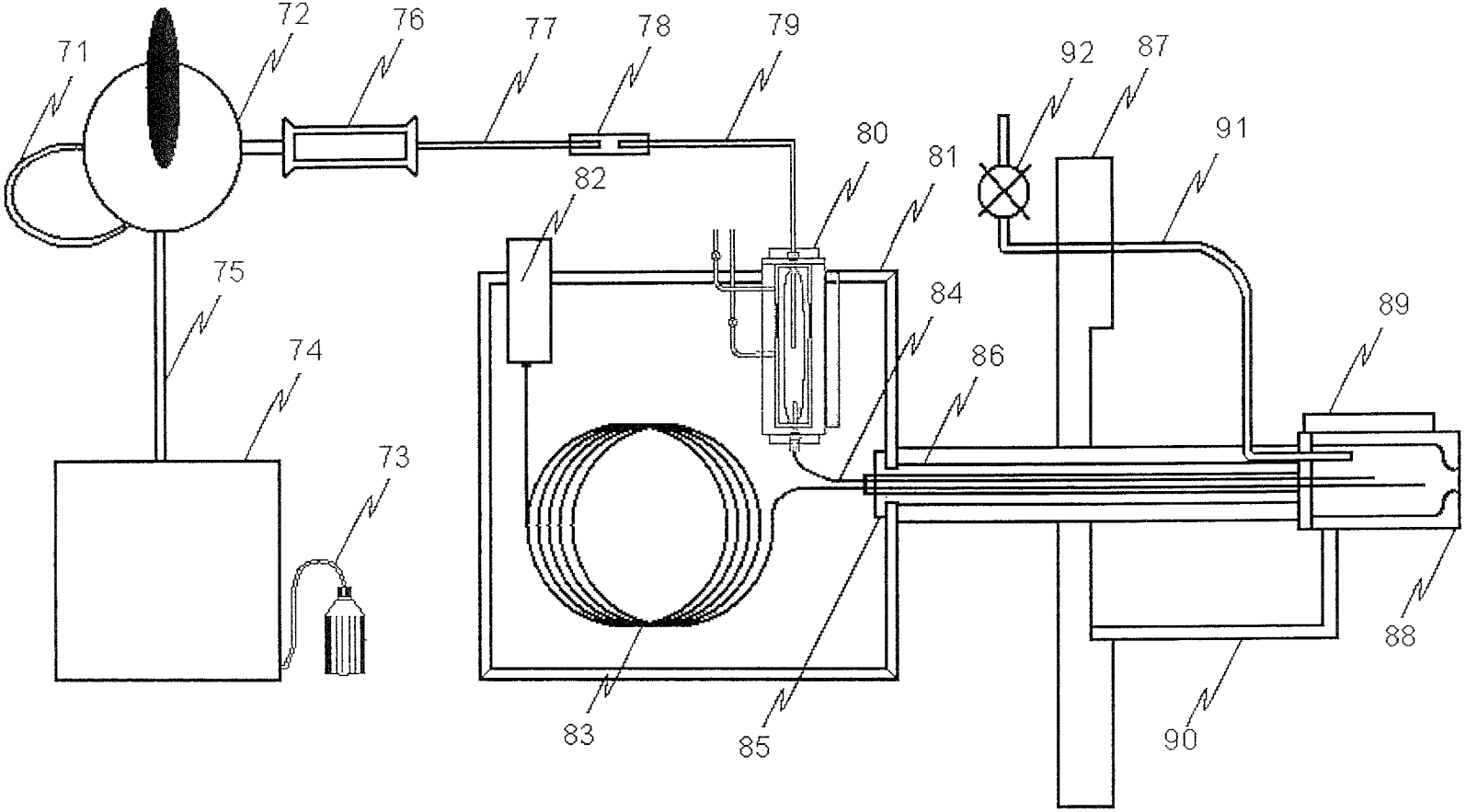
FIG. 4 is a schematic diagram illustrating another modification of the capillary separated vaporization chamber and nozzle device according to the present invention.

In FIG. 4 there is illustrated a schematic diagram of another alternative embodiment of the capillary separated vaporization chamber and nozzle device, aimed at obtaining alternate LC-MS and GC-MS analyses. Accordingly, the LC sample is introduced into the sample loop 71 that is located on the flow injection valve 72. Solvent is pumped from the solvent container 73 by the LC pump 74 into solvent delivery tube 75 and sweeps the sample from its loop 71 into the liquid chromatography column 76 for the separation of the sample compounds in time as normally achieved with LC analysis. The sample is eluted from the LC column output into solvent delivery tube 77 and enters union 78 which also connects solvent delivery tube 79 that is adapted to bring a steady flow of liquid solution with the sample for its nebulization, spray formation and vaporization in the vaporization chamber 80. Unique to the device according to FIG. 4 is that the vaporization chamber 80 is mounted on a gas chromatograph 81. It is either a modified GC injector or a separately designed vaporization chamber that is only mounted for convenience on the gas chromatograph. The gas chromatograph has a separate GC injector 82 and GC separation column 83, and both the GC separation column 82 and vaporization chamber 80 through output capillary transfer line 84 enter transfer line 85 that is separately heated by heater 86. The transfer line 85 is coupled with the vacuum chamber by a vacuum flange 87 and the two capillary transfer lines 83, 84 output the vaporized sample (either from the GC or LC) inside supersonic nozzle structure 88 that is heated by nozzle heater 89 and supported by the thermally insulated support 90. The nozzle can also accept make-up gas through tube 91 whose flow rate is regulated by flow control valve 92.

The devices according to FIGS. 3 and 4 both serve for the same purpose of enabling alternate LC-MS and GC-MS analysis without a change of hardware, but with emphasis on better optimization of LC-MS analysis (FIG. 3) or GC-MS analysis (FIG. 4). Depending on the exact design both options can be effective in both analyses. The optimal supersonic nozzle diameter is different from GC-MS and EI LC-MS with SMB and while for GC-MS with SMB it is about 100 μm for EI LC-MS it is about 320 μm in order to suppress cluster formation and also to reduce nozzle clogging. The 100 μm nozzle, however, works well with low LC liquid flow rates up to about 4 microliters/min. This upper flow rate limit can be extended by liquid flow splitting before the vaporization chamber or conveniently at the vaporization chamber. 320 μm nozzle diameter is optimized for EI LC-MS with SMB and can serve also for GC-MS with SMB but with a sacrifice of sample cooling efficiency which can be tolerated for certain applications. It should be noted that at low liquid flow rates thermally assisted spray at the sample vaporization chamber is practically un-avoided and thus Thermospray can be used without any pneumatic assistance. The onset of Thermospray can be pushed to lower liquid flow rated by using air cooled pneumatic spray element inside the heated vaporization chamber for having maximal axial temperature gradient (even when no pneumatic gas is added). Since with low liquid flow rates the amount of sample and hence chances of clogging of the liquid transfer line is reduced, and since Thermospray is the simplest method of spray formation, and in consideration of the ease of maintenance of the solvent delivery tube according to the present invention, Thermospray can be considered for use with low LC flow rates of stable samples.

The mounting of the vaporization chamber on a gas chromatograph as described in FIG. 4 is a convenient and practical approach for achieving alternate LC-MS and GC-MS with a single MS system and without hardware change.

Experiments were performed with a Varian 1200 mass spectrometry system (Varian Inc. Walnut Creek, Calif., USA) which was converted to operate with a supersonic molecular beam interface and its fly-through electron ionization ion source, as described in detail for GC-MS with SMB experiments in A. B. Fialkov, U. Steiner, L. Jones and A. Amirav, *Int. J Mass. Spectrom.* 251, 47-58 (2006). In one set of experiments with the device according to the present invention, a Varian model 1177 injector mounted on a Varian model 3800 gas chromatograph was modified to serve as a vaporization chamber for the capillary separated vaporization chamber and nozzle device. 40 cm long 0.25 mm ID Vespel coated deactivated fused silica served as the capillary transfer line. It was operated with 30 ml/min combined helium and vaporized methanol or water/methanol and sample mixture flow rate with about 50 ml/min added helium make up gas before the nozzle. The nozzle was made from Vespel polyimide material with 100 μm and/or 300 μm diameter. The vaporization chamber liner was a standard Varian 1177 GC injector liner with 4 mm ID, ¼" OD and 85 mm length. Thermospray and pneumatic spray were investigated. For Thermospray, fused silica transfer lines were used with 30 μm ID at solution flow rate of 10-200 microliter/min with certain split ratio in the range of 2 to 30. For pneumatic spray, a home made air cooled aluminum sprayer was inserted into the liner and was operated with 100-150 ml/min helium as nebulizing gas. The nebulizer shape and type is called "extended nozzle type" in the literature. An Agilent liquid chromatograph model 1100 was used (Agilent Technologies, Wilmington, Del., U.S.A.). An additional capillary separated vaporization chamber and nozzle device was produced having the same liner as used with the Varian 1177 injector and 8 cm long 0.25 mm ID capillary which separated this vaporization chamber and a 300 μm Vespel nozzle. This device was heated with a 200 Watts cartridge heater and a separate temperature controller (30-450° C. temperature range) and electronic flow control made by Aalborg that provided 50-200 ml/min helium flow rate. A range of samples was tested without exhibiting tailing by flow injection and LC-MS analysis, with the biggest compound having molecular weight of 774 amu ($C_{58}H_{78}O_3$ CAS 1709-70-2). For this relatively large compound, vaporization chamber temperature of 300-350° C. was needed combined with a temperature of 300° C. for heating the capillary transfer line and 280° C. nozzle temperature. Electrospray experiments were performed as in FIG. 2 with voltage in the 3-5 KV range and methanol liquid flow rate in the 20-200 μL/min range. The electrospray was performed inside a Varian 1177 injector glass liner which was held at a temperature above 150° C. (typically 300° C.). A fused silica transfer line with 100 micron I.D. and 350 micron O.D. served as the electrospray tip and the liquid was charged in a metal union about 6 cm behind the transfer line edge.

It will be evident to those skilled in the art that the invention is not limited to the details of the foregoing illustrated embodiments and that the present invention may be embodied in other specific forms without departing from the essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

A list of the reference numerals is set forth as follows:

1. Sample loop
2. flow injection valve
3. solvent container
4. LC pump
5. solvent delivery tube
6. LC column
7. solvent delivery tube
8. union
9. solvent delivery tube
10. vaporization chamber
11. pneumatic sprayer element
12. deactivated glass or fused silica liner
13. heated block
14. heater element
15. internal seal
16. clamped ferrule
17. tubing
18. regulating or control valve
19. split flow output tube
20. valve
21. capillary transfer line
22. ferrule seal
23. vacuum chamber flange
24. guiding structural element
25. heater element
26. supersonic nozzle
27. nozzle mounting block
28. nozzle heater
29. gas tube
30. electronic flow control
31.-40. not used
41. solvent delivery tube
42. union
43. high voltage Power Supply
44. delivery tube
45.-49. not used
50. GC
51. GC standard injector
52. GC column
53. GC heated transfer line
54. heater
55. GC unified interface box
56. heater
57. LC vaporized sample capillary transfer line
58. dual holes ferrule
59. guiding structural element
60. heater element
61. supersonic nozzle
62.-70. not used
71. sample loop
72. flow injection valve
73. solvent container
74. LC Pump
75. solvent delivery tube
76. liquid chromatography column
77. solvent delivery tube
78. union
79. solvent delivery tube
80. vaporization chamber
81. gas chromatograph
82. separate GC injector
83. GC separation column
84. output capillary transfer line
85. transfer line
86. heater
87. vacuum flange

88. supersonic nozzle structure
89. nozzle heater
90. thermally insulated support
91. gas tube
92. flow control valve Clearly, various change and modifications may be made without departing from the scope of the invention as described in the specification.

The invention claimed is:

1. A method for introducing a sample into a supersonic molecular beam for mass spectrometry analysis, said method comprising:

directing sample compounds to be analyzed in a flowing liquid solvent towards a sample vaporization chamber located upstream of a supersonic nozzle;

forming a spray from said sample compounds in a flowing liquid;

heating said spray in the sample vaporization chamber to vaporize said sample compounds thereby simultaneously forming vaporized sample compounds and vaporized solvent prior to expansion of the sample compounds and vaporized solvent from said supersonic nozzle;

expanding said vaporized sample compounds and vaporized solvent from said supersonic nozzle into a vacuum system, forming a supersonic molecular beam with both vibrationally cold sample molecules and vaporized solvent;

ionizing with electrons said sample compounds while contained as vibrationally cold molecules in said supersonic molecular beam in a fly-through electron ionization ion source;

mass analyzing the ions formed from said sample compounds;

detecting said ions formed from said sample compounds after mass analysis and generating mass spectral information, processing the data obtained from the resulting mass spectral information for identifying and/or quantifying the chemical content of said sample, wherein:

said sample vaporization chamber is connected to said supersonic nozzle by a flow restrictor element that physically separates between the vaporization chamber and supersonic nozzle and serves to impede flow while transferring the sample vapor into the nozzle for supersonic expansion at a low pressure that eliminates formation of clusters of the sample compounds with the solvent in the supersonic expansion; and said sample vaporization is completed in said vaporization chamber prior to its entry to said flow restrictor element.

2. The method according to claim 1, wherein the spray in said sample vaporization chamber is formed by electrospray.

3. The method according to claim 1, wherein said sample vaporization chamber is mounted on a gas chromatograph, enabling sample introduction to said supersonic nozzle from a liquid chromatograph and gas chromatograph without a change of hardware.

4. The method according to claim 1, wherein said flow restrictor element provides a pressure difference greater than a factor of 2 between a high pressure side in said sample vaporization chamber and a low pressure side behind said supersonic nozzle.

5. The method according to claim 1, wherein said flow restrictor element is a flexible and non straight capillary.

6. The method according to claim 1, wherein said flow restrictor element is heated and temperature controlled independently from the sample vaporization chamber.

7. The method according to claim 1, wherein said sample vaporization chamber includes an inert glass or fused silica liner having an internal diameter greater than 0.5 mm.

8. The method according to claim 1, wherein make up gas is fed to the nozzle in addition to the vaporized sample and solvent exiting said flow restrictor element.

9. The method according to claim 1, wherein said spray formation is aided by helium or hydrogen light gas.

10. The method according to claim 1, wherein the sample compounds to be analyzed in said flowing liquid are directed towards said sample vaporization chamber from at least one of a liquid chromatograph and a sample loop in a flow injection valve.

11. The method according to claim 2, wherein said electrospray is formed from a non-conducting solvent delivery tube located inside a heated glass liner, also acting as an electrospray counter-electrode.

12. A device for introducing a sample in a flowing liquid into a supersonic molecular beam for its mass spectrometry analysis, the device comprising:

a sample vaporization chamber located upstream of a supersonic nozzle;

a flow restrictor element separating the sample vaporization chamber and said supersonic nozzle that physically separates between the vaporization chamber and supersonic nozzle and serves to impede flow while transferring the sample vapor into the nozzle for supersonic expansion at a low pressure that eliminates formation of clusters of the sample compounds with the solvent in the supersonic expansion;

spray formation means for formation of a spray from said sample in the flowing liquid;

a heater for heating the spray in the sample vaporization chamber so as to vaporize the sample compounds thereby simultaneously forming vaporized sample compounds and vaporized solvent prior to expansion of the sample compounds and vaporized solvent from said supersonic nozzle;

a vacuum system into which said supersonic nozzle induces supersonic expansion of the vaporized sample compounds and vaporized solvent, for forming a supersonic molecular beam with both vibrationally cold sample molecules and vaporized solvent;

a fly-through electron ionization ion source for the ionization of said sample compounds while contained, as vibrationally cold molecules, in said supersonic molecular beam;

a mass analyzer for mass analysis of ions formed from the sample compounds in said fly-through ion source;

an ion detector for the detection of said ions formed from said sample compounds after mass analysis and generating mass spectral information; and means for data processing of the resulting mass spectral information, for identifying and/or quantifying the chemical content of said sample.

13. The device according to claim 12, wherein said spray formation means is electrospray.

14. The device according to claim 12, wherein said sample vaporization chamber is mounted on a gas chromatograph and further includes means for sample introduction to said supersonic nozzle from a liquid chromatograph and gas chromatograph without a change of hardware.

15. The device according to claim 12, wherein said capillary separating the sample vaporization chamber and said supersonic nozzle provides a pressure difference greater than a factor of 2 between a high pressure side in said sample vaporization chamber and a low pressure side behind said supersonic nozzle.

16. The device according to claim 12, wherein said flow restrictor element is a flexible and non-straight capillary.

17. The device according to claim 12, wherein said flow restrictor element is heated and temperature controlled independently from the sample vaporization chamber.

18. The device according to claim 12 further including means for the provision of make up gas upstream of said supersonic nozzle.

19. The device according to claim 12, wherein said spray formation means is operated with helium or hydrogen light gas.

20. The device according to claim 12, wherein said sample compounds to be analyzed in the flowing liquid are directed towards a supersonic nozzle from a liquid chromatograph and/or a sample loop in a flow injection valve.

21. The device according to claim 13, wherein said electrospray is formed from a non-conducting solvent delivery tube inside a heated glass liner that also acts as an electrospray counter electrode.

22. A method for introducing a sample into a supersonic molecular beam for mass spectrometry analysis using a sample vaporization chamber located upstream of a supersonic nozzle, said method comprising:

directing sample compounds to be analyzed in a flowing liquid towards said vaporization chamber;

funning a spray from said sample compounds in a flowing liquid;

vaporizing said sample compounds in said spray in said vaporization chamber prior to expansion of the sample compounds and vaporized solvent from said supersonic nozzle;

expanding said vaporized sample compounds and solvent from said supersonic nozzle into a vacuum system, forming a supersonic molecular beam with vibrationally cold sample molecules and vaporized solvent;

ionizing with electrons said sample compounds while contained as vibrationally cold molecules in said supersonic molecular beam in a fly-through electron ionization ion source;

mass analyzing the ions formed from said sample compounds;

detecting said ions formed from said sample compounds after mass analysis, and processing the data obtained from the resulting mass spectral information, for identifying and/or quantifying the chemical content of said sample, wherein: said sample vaporization chamber is connected to said supersonic nozzle by a capillary transfer line;

said sample vaporization is completed in said vaporization chamber prior to its entry to said capillary transfer line;

and, said vaporized sample compounds and liquid are transferred in said capillary transfer line into said supersonic nozzle; and said sample vaporization chamber is separated from said supersonic nozzle by a deactivated fused silica or inert metal transfer line with internal diameters in the 0.1 mm up to 0.53 mm diameter range and length above 25 mm, and wherein said transfer line capillary has a length and diameter providing about one atmosphere absolute pressure in said vaporization chamber at the liquid flow rate used and/or enable opening the vaporization chamber to air without overloading any vacuum pump.

23. A device for introducing a sample in a flowing liquid into a supersonic molecular beam for its mass spectrometry analysis, comprising:

a vaporization chamber located upstream of a supersonic nozzle;

a capillary separating the vaporization chamber and said supersonic nozzle;

means for spray formation from said sample in the flowing liquid;

a vacuum system into which said supersonic nozzle induces supersonic expansion of the vaporized sample compounds and vaporized solvent, for forming a supersonic molecular beam with vibrationally cold sample molecules and vaporized solvent;

a fly-through electron ionization ion source for the ionization of said sample compounds while contained, as vibrationally cold molecules, in said supersonic molecular beam;

a mass analyzer for mass analysis of ions formed from the sample compounds in said fly-through ion source;

an ion detector for the detection of said ions formed from said sample compounds after mass analysis; and means for data processing of the resulting mass spectral information, for identifying and/or quantifying the chemical content of said sample; and said sample vaporization chamber is separated from said supersonic nozzle by a deactivated fused silica or inert metal transfer line with internal diameters in the 0.1 mm up to 0.53 mm diameter range and length above 25 mm, and wherein said transfer line capillary has a length and diameter providing about one atmosphere absolute pressure in said vaporization chamber at the liquid flow rate used and/or enable opening the vaporization chamber to air without overloading any vacuum pump.

24. The method according to claim 22, wherein the spray in said sample vaporization chamber is formed by electrospray.

25. The method according to claim 22, wherein said sample vaporization chamber is mounted on a gas chromatograph, enabling sample introduction to said supersonic nozzle from a liquid chromatograph and gas chromatograph without a change of hardware.

26. The method according to claim 22, wherein said capillary transfer line provides a pressure difference greater than a factor of 2 between a high pressure side in said sample vaporization chamber and a low pressure side behind said supersonic nozzle.

27. The method according to claim 22, wherein said capillary transfer line is a flexible and non straight capillary.

28. The method according to claim 22, wherein said capillary transfer line is heated and temperature controlled independently from the sample vaporization chamber.

29. The method according to claim 22, wherein said sample vaporization chamber includes an inert glass or fused silica liner having an internal diameter greater than 0.5 mm.

30. The method according to claim 22, wherein make up gas is fed to the nozzle in addition to the vaporized sample and solvent exiting said capillary transfer line.

31. The method according to claim 22, wherein said spray formation is aided by helium or hydrogen light gas.

32. The method according to claim 22, wherein the sample compounds to be analyzed in said flowing liquid are directed towards said sample vaporization chamber from at least one of a liquid chromatograph and a sample loop in a flow injection valve.

33. The method according to claim 24, wherein said electrospray is formed from a non-conducting solvent delivery tube located inside a heated glass liner, also acting as an electrospray counter-electrode.

34. The device according to claim 23, wherein said spray formation means is electrospray.

35. The device according to claim 23, wherein said sample vaporization chamber is mounted on a gas chromatograph and further includes means for sample introduction to said supersonic nozzle from a liquid chromatograph and gas chromatograph without a change of hardware.

36. The device according to claim 23, wherein said capillary separating the sample vaporization chamber and said supersonic nozzle provides a pressure difference greater than a factor of 2 between a high pressure side in said sample vaporization chamber and a low pressure side behind said supersonic nozzle.

37. The device according to claim 23, wherein said capillary transfer line is a flexible and non-straight capillary.

38. The device according to claim 23, wherein said capillary transfer line is heated and temperature controlled independently from the sample vaporization chamber.

39. The device according to claim 23 further including means for the provision of make up gas upstream of said supersonic nozzle.

40. The device according to claim 23, wherein said spray formation means is operated with helium or hydrogen light gas.

41. The device according to claim 23, wherein said sample compounds to be analyzed in the flowing liquid are directed towards a supersonic nozzle from a liquid chromatograph and/or a sample loop in a flow injection valve.

42. The method according to claim 1, wherein said flow restrictor element is a deactivated fused silica or inert metal transfer line with internal diameters in the 0.1 mm up to 0.53 mm diameter range and length above 25 mm, and which is dimensioned to provide above one atmosphere absolute pressure in said vaporization chamber at the flowing liquid flow rate used and/or enable opening of the vaporization chamber to air without overloading any vacuum pump.

43. The device according to claim 12, wherein said flow restrictor element is a deactivated fused silica or inert metal transfer line with internal diameters in the 0.1 mm up to 0.53 mm diameter range and length above 25 mm, and which is dimensioned to provide above one atmosphere absolute pressure in said vaporization chamber at the flowing liquid flow rate used and/or enable opening of the vaporization chamber to air without overloading any vacuum pump.

* * * * *